United States Patent [19]

Burnett, Jr.

[11] 4,339,843

[45] Jul. 20, 1982

[54] DOOR CLOSER WITH ASSIST OR DOOR OPERATING FEATURES

[75] Inventor: L. Nelson Burnett, Jr., Pottstown, Pa.

[73] Assignee: Reading-Dorma Closer Corporation, Reamstown, Pa.

[21] Appl. No.: 153,741

[22] Filed: May 27, 1980

Related U.S. Application Data

[63] Continuation-in-part of Ser. No. 888,217, Mar. 20, 1978, Pat. No. 4,222,147.

[51] Int. Cl.[3] ..... E05F 3/00

[52] U.S. Cl. ..... 16/62; 49/30; 49/32; 49/340; 91/38; 91/318

[58] Field of Search ..... 16/49, 62, 51, 66, 52, 16/58; 91/38, 318; 49/29, 32, 30, 274, 340, 341; 192/109 F

[56] References Cited

U.S. PATENT DOCUMENTS

| | | | |
|---|---|---|---|
| 2,190,653 | 2/1940 | Dunn | 49/32 |
| 3,084,927 | 4/1963 | Linder | 49/340 X |
| 3,145,796 | 8/1964 | Padula | 91/318 X |
| 3,160,486 | 12/1964 | Busch | 91/38 X |
| 3,478,468 | 11/1969 | Martin | 49/137 |
| 3,864,875 | 2/1975 | Hewitt | 49/340 X |

*Primary Examiner*—George H. Krizmanich
*Attorney, Agent, or Firm*—Robert C. Podwil

[57] ABSTRACT

Hydraulic door closer apparatus has associated with it means for counter-balancing the bias of a return spring, to assist in opening the door by reducing the force needed to open it, or to open the door by over-balancing the bias of the return spring. Remotely manually operable means may initiate opening of the door.

10 Claims, 10 Drawing Figures

FIG. 1
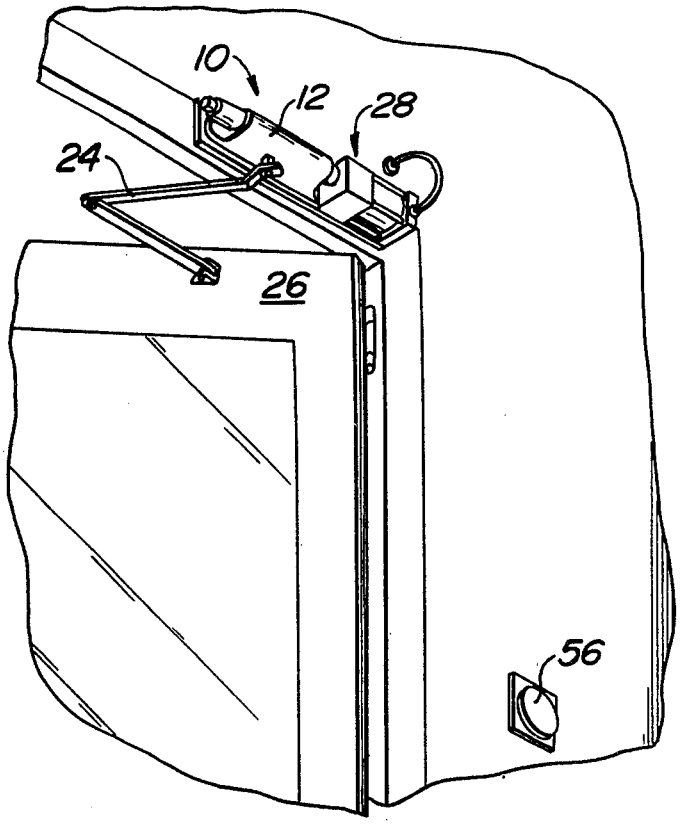
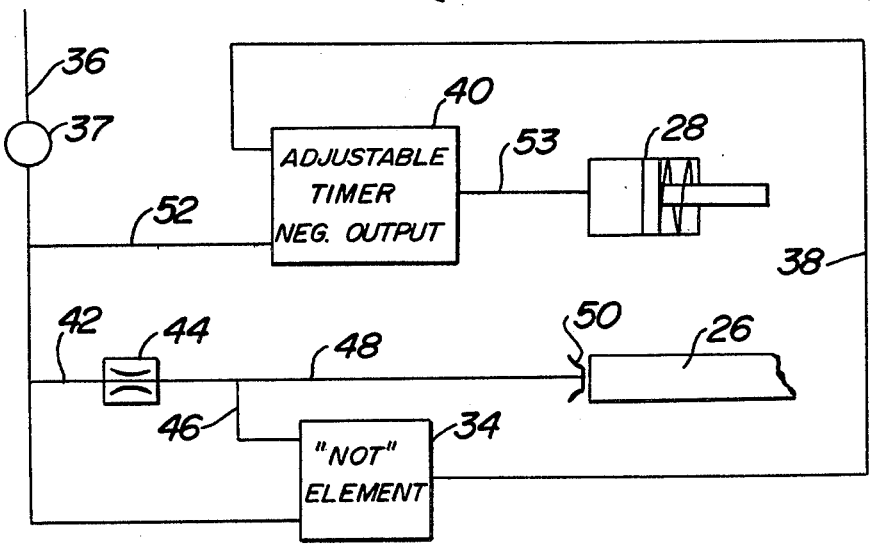
FIG. 4

FIG. 5
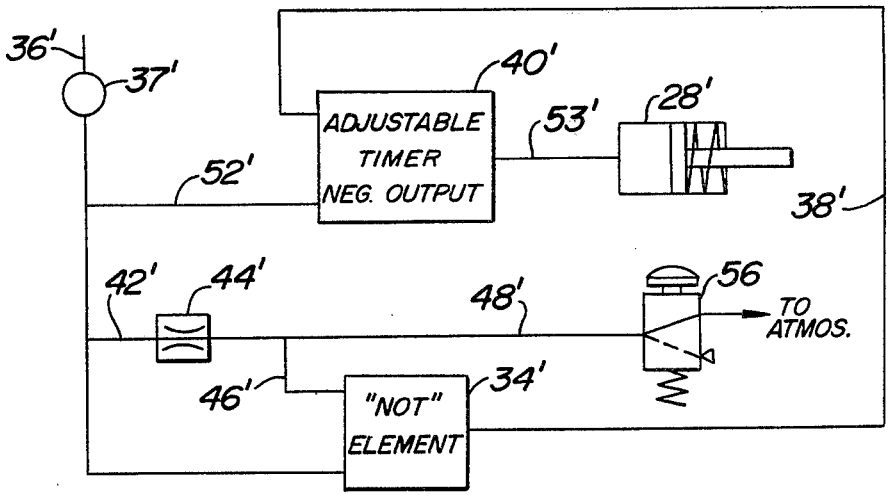
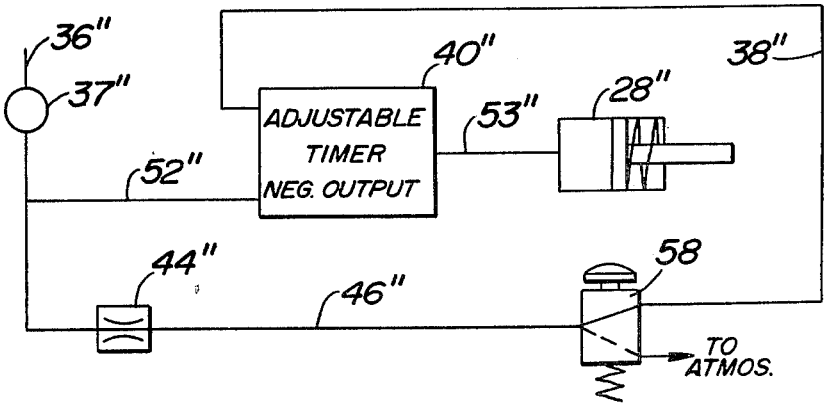
FIG. 6

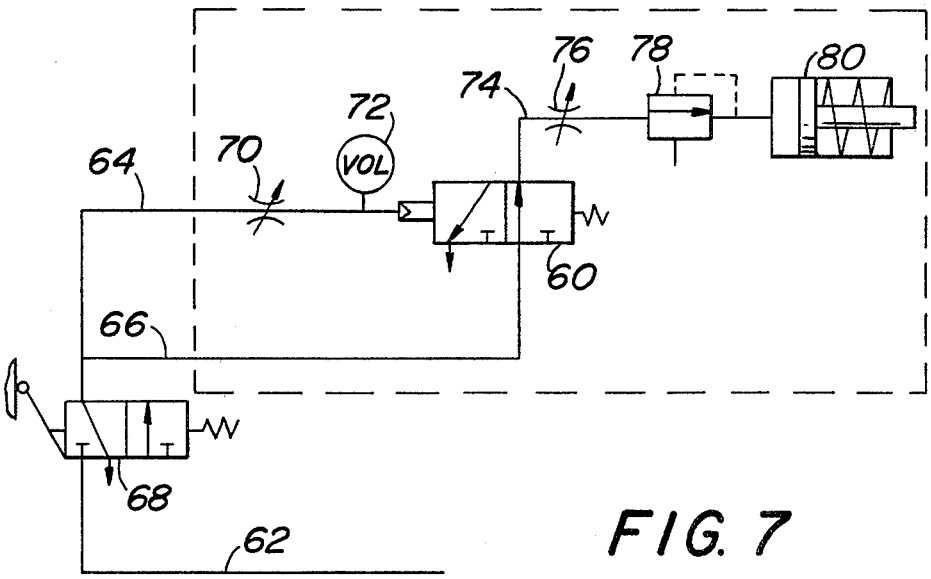
FIG. 7
FIG. 8
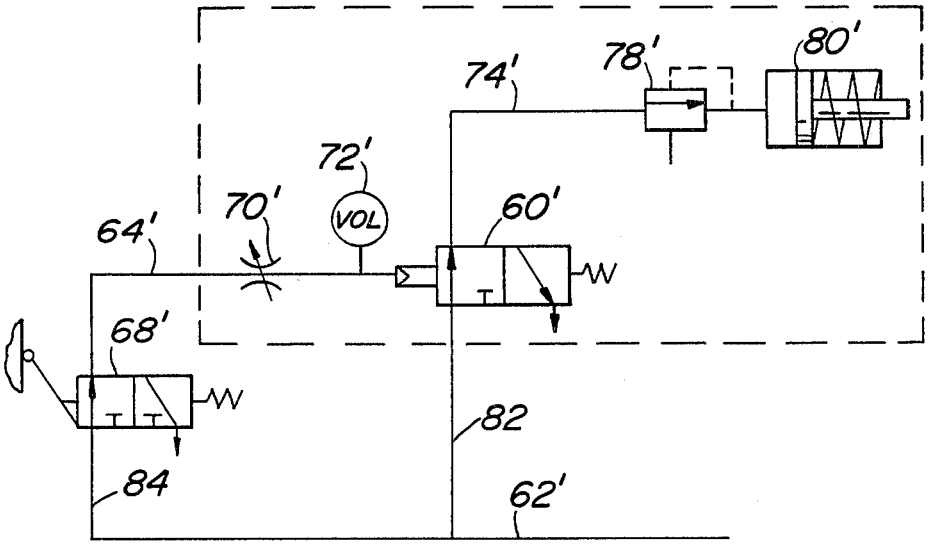

DOOR CLOSER WITH ASSIST OR DOOR OPERATING FEATURES

BACKGROUND OF THE INVENTION

This is a continuation-in-part of application Ser. No. 888,217, filed Mar. 20, 1978, now U.S. Pat. No. 4,222,147.

This invention relates to hydraulic door closer apparatus, and more particularly, to hydraulic door closer apparatus having "assist" or "operating" features to facilitate opening of a door. It relates to the general type of hydraulic door closer illustrated in U.S. Pat. No. 4,019,220 issued Apr. 26, 1977 to Sidney Lieberman, and assigned to the assignee of the present invention, in which a spring-urged hydraulic piston is arranged to bias a door to its closed position, with appropriate hydraulic damping. Typically, in the application of apparatus of this sort, a closing force generated by a spring is transmitted between the closer and, depending upon where the closer is mounted, either the door or door frame. For this purpose, it is conventional practice to provide a linkage consisting of one or more links, coupled to the unit and to the door or door frame, as the case may be. In the apparatus shown in U.S. Pat. No. 4,019,220, issued Apr. 26, 1977, a rack and pinion arrangement is used to convert the linear movement of the piston within its cylinder to rotary or oscillating motion of the linkage.

Upon opening of the door, the piston is driven by the pinion against the bias of a return spring and the fluid resistance provided by fluid flow within the device. Movement of the door toward the closed position is caused by unloading of the return spring, and the speed of closing is controlled by appropriate damping provided by the hydraulics.

In certain applications, most notably in the cases of hospitals, old-age homes and facilities used by handicapped persons, it is desirable or even required by law that doors normally be closed, yet even the relatively modest opening forces needed to overcome conventional door closers may be excessive for such persons. Indeed, in any facility used by handicapped persons, the resistance to opening generated by conventional closers may be insurmountable.

Apparatus for power-assisted opening of a door, with spring-urged closing, has heretofore been proposed. See, for example, U.S. Pat. No. 2,190,653, issued Feb. 20, 1940 to Andrew C. Dunn, and U.S. Pat. No. 3,478,468, issued Nov. 18, 1969, to Paul W. Martin, a hydraulic door operating system was proposed in substitution for the familiar hydraulic door closer.

It is a principal object, however, of this invention, to provide novel and efficient apparatus in which operation of a door is achieved by means of a door closer, over-balanced by a pneumatic actuator associated with it.

It is another object of this invention to provide apparatus in which the closing bias of a door closer is nearly balanced to reduce the needed initial opening force of a door.

It is another object of this invention to provide a mechanically simple door closer, energy efficient in its operation, and relatively easy to install with a minimum of skilled labor, and in particular, requiring no electrical controls.

Other objects will appear hereinafter.

In U.S. Pat. No. 3,875,612, issued Apr. 8, 1975 to Edward J. Poitras, and in numerous others, apparatus has been proposed whereby a door with an associated closer device can be manually moved to selected positions and held there by the action of retained hydraulic fluid, or allowed to close upon the happening of a designated condition.

Also known are devices such as the one shown in U.S. Pat. No. 3,934,306 issued Jan. 27, 1976, to Vernie L. Farrix, for a hold-open device, whereby the operation of a door closer is countered until the happening of a contingency such as fire. In accordance with the Farrix patent, a selectively disengageable brake is operatively associated with the door closer arm, operation of the brake serving to impede closing of the door in response to the urging of the closure.

Such devices do not, however, accomplish the objects of the present invention.

The foregoing and other objects are realized, in a presently preferred form of the invention, by a door closer essentially conventional in its construction, to which there is assembled a pneumatically controlled and powered actuator, arranged to oppose the biasing force of the return spring of the closer. The door closer in accordance with the invention has a housing providing a cylinder, a piston disposed in the cylinder, and force transmitting means such as a linkage coupled to the piston for transmitting forces to and from the piston. The actuator is coupled to the housing, and applies to the piston forces in opposition to the bias of the return spring.

The actuator in one embodiment of the invention disclosed in my above-mentioned co-pending application provides an adjustable force sufficient to nearly balance the force of the biasing spring, so that very light forces serve to open the door. In an alternative embodiment, the actuator applies to the piston an adjustable force sufficent to overbalance the biasing force of the spring, thus opening the door in response to operation of the device. In the first case, the so-called "assist" mode, the actuator normally applies a counter-balancing force to the piston, but manual opening of the door causes a timer to begin operation, which removes the force after an adjustable predetermined interval, thus enabling the closer to operate in the normal fashion to close the door. In the second case, the so-called "operating" mode, the operation of a remotely manually operable switch causes operation of the actuator to overbalance the biasing force of the spring, to open the door. "Timing out" of the timer after release of the switch enables the closer to close the door.

The apparatus disclosed herein, which constitutes the best mode presently contemplated for carrying out the invention, provides, in one of its embodiments, for application in opposition to the actuator an "assist" force (leaving a residual closing force on the order of 3 to 5 pounds) so that relatively light forces serve to initially open the door, and the door is closed by the closer upon "timing out" of a fluid element having an adjustable time constant. In other presently disclosed embodiments, upon initial opening of the door or actuation of a switch, the actuator applies to the piston a force sufficient to over-balance the biasing force of the closer spring, thus "operating" the door. As before, "timing out" of a fluid element having an adjustable time constant serves to release the closer to permit closing of the door under the influence of the closer.

There are seen in the drawings forms of the invention which are presently preferred, it being understood that this invention is not limited to the precise arrangements and instrumentalities shown.

FIG. 1 is a perspective view showing door closer apparatus in accordance with the invention operatively disposed in association with a door.

FIG. 4 is a schematic diagram showing a form of control system for the apparatus, particularly as used as an assist to door opening.

FIG. 5 is a schematic diagram showing a form of control system for the apparatus as used in the operating mode, to open a door.

FIG. 6 is a schematic diagram showing an alternative form of control system for the apparatus as used in the operating mode.

FIG. 7 is a schematic diagram showing an alternative form of control system for the apparatus, in which, as in the embodiment of FIG. 4, an "assist" force is applied while the door is closed and for a period thereafter sufficient to allow a person to pass through the door.

FIG. 8 is a schematic diagram showing an alternative form of control system for the apparatus, in which an operating force is applied to the door after initial manual opening.

DETAILED DESCRIPTION

Figure 2:
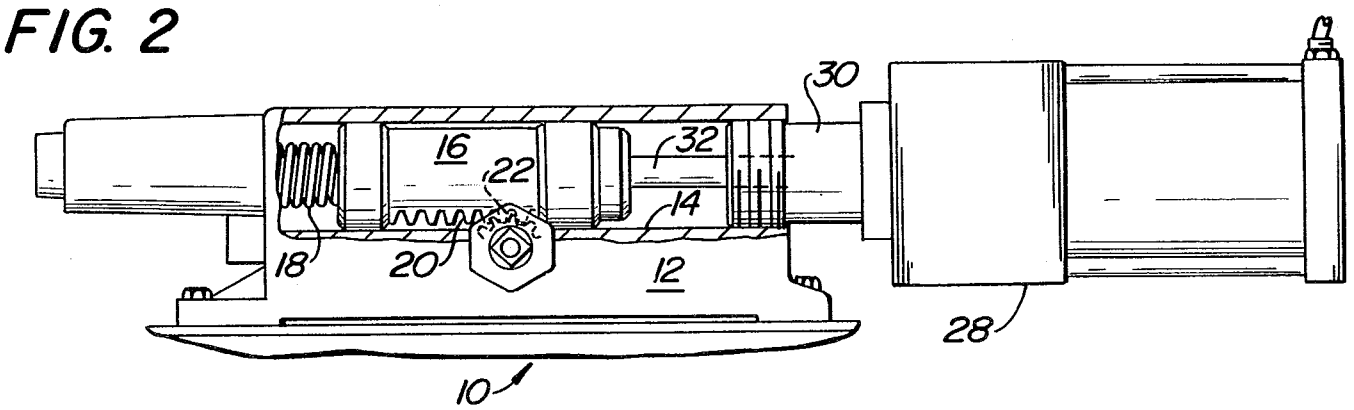
FIG. 2 is a partial cross-sectional view showing a portion of the door closer apparatus in accordance with this invention.
Figure 3:
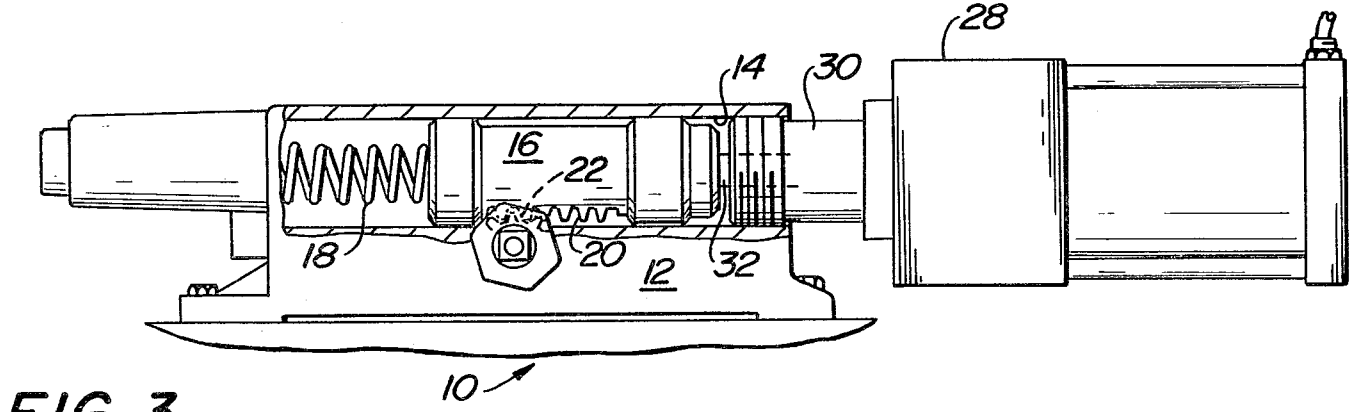
FIG. 3 is a partial cross-sectional view, similar to FIG. 2, but showing the apparatus in a different condition of operation.

Referring now to the drawings in detail, wherein like reference numerals indicate like elements, there is seen in FIG. 1 door closer apparatus designated generally by the reference numeral 10. With reference to FIGS. 2 and 3, the door closer apparatus 10 includes a case or housing 12, provided with a bore 14, in which a piston 16 is slidably disposed.

The housing 12 will be understood by those skilled in the art to have within it suitable fluid passages, not shown, and adjustable valves associated with the passages to control fluid flow within them.

Received within the bore 14 is a return spring 18 associated with the above-mentioned piston 16.

It will be understood that the piston 16 is reciprocable within the bore 14, and that the bore 14 is ordinarily filled with fluid. A rack 20 associated with the piston 16 engages a pinion 22 which is pivotably mounted, by suitable means, not shown, in housing 12.

A suitable linkage 24 interconnects the pinion 22 and a door 26 with which the apparatus 10 is associated. Thus, the pinion 22 and control linkage 24 serve as force transmitting means, to transmit forces to and from the piston 16 to control movement of the door 26.

Referring again to FIGS. 2 and 3, there is associated with the piston 16 an actuator, designated generally by the reference numeral 28, coupled to the housing 12 in such a manner as to be able to apply force to the piston 16 in opposition to the bias of the return spring 18. In the illustrated form of the invention, a portion 30 of the actuator 28 serves to seal an end of the bore 14, and provides a simple and efficient mounting means coupling the actuator 28 to the housing 12. The actuator 28 in the illustrated and preferred form of the apparatus, is a pneumatic actuator.

A piston rod 32, coupled to a piston (not shown) of the actuator 28, extends through the portion 30 of the actuator 28, and into engagement with a face of the piston 16. Thus, the piston rod 32 is a force transmitting member in the sense that the application of force through the piston rod 32 will transmit, by direct contact with the piston 16, a force to the piston 16 in a direction parllel to the axis of the housing 12 and piston 16, in opposition to the bias of the return spring 18.

It should be evident that the application through the piston 16 of forces insufficient to overbalance the force of the return spring 18 may nevertheless significantly lessen the amount of additional force needed to move the piston 16 against the bias of the return spring 18. When the apparatus 10 is configured to provide such a force to the piston 16, it is said to be in the "assist" mode, that is, in a condition in which the apparatus assists opening of the door 26, but does not in fact open it.

When the apparatus 10 is configured to overbalance the force of the return spring 18, operation of the actuator 28 will serve to open the door. In this condition, the unit may be described as being in an "operating" mode.

Referring now to FIG. 4, there is seen, in schematic, a system by which the actuator 28 may be controlled to assist door opening.

The reference numeral 34 in the Figure designates a so-called "NOT" pneumatic logic element, that is, an element which operates as a valve, and permits the passage of air through it in the absence of a control signal. The NOT element 34 is coupled to a source of filtered and regulated air through a supply conduit 36 and regulator 37, and by a second conduit 38 is connected to a timer element 40 which will shortly be described in greater detail. In installations using several doors, the supply conduit 36 will ordinarily be a common supply for all installations.

Tapped from the conduit 36 is a conduit 42 containing a pressure reducing orifice 44. The orifice 44 reduces the pressure in the conduit 36 to a control pressure for the NOT element, less than the pressure in the conduit 36. Downstream of the orifice 44 there is a conduit 46, supplying the control input to the NOT element 34, and a conduit 48, in which there is placed a door position-sensing bleed valve 50. When closed, the door 26 so obstructs the bleed valve 50 as to effectively close it, thus normally maintaining pressure in the conduits 46 and 48, and causing the NOT element 34 to obstruct the conduit 38 and leave it unpressurized.

The timer element 40 receives through a conduit 52 pressure from the conduit 36, and, in the absence of a control signal from the NOT element (manifested by pressure in the conduit 38) passes pressure to the actuator 28 through a conduit 53. Thus, the timer element 40 may be categorized as a "negative output" timer, in the sense that it normally allows an output in the absence of a control signal.

Application of a control signal to the timer element 40 causes the timer element 40 to time out after an adjustable period of time, and timing out of the timer element 40 cuts off pressure to the actuator 28 and permits the actuator 28 to exhaust.

The operation of the apparatus 10 in the assist mode should now be apparent: at the start of an operative cycle, the door 26 will be closed, and consequently, the bleed valve 50 closed and the conduits 46 and 48 pressurized. Thus, with a signal applied to the NOT element, no signal passes to the timer element 40. hence, the "negative output" timer element 40 passes air to the actuator 28 to assist door opening in the above-described manner. As the door 26 is opened, however, the bleed valve 50 is opened, and pressure in the conduits 46 and 48 is lost. In the absence of the control signal in the conduit 46, the NOT element passes air to the conduit 38, thus applying a signal to the timer element 40. The application of such a signal starts timing of the timer element 40, and after the adjustable time interval, the timer element 40 times out, to exhaust the actuator 28 and allow the door 26 to close normally. When the door 26 is again closed, the bleed valve 50 is again covered; the NOT element is again provided with a control signal and therefore blocks flow of air in the conduit 38; the timer element 40 again allows flow in the absence of the control signal; and the actuator 28 is again pressurized to provide assist.

By way illustration, with one presently contemplated form of door closer, air at 30 p.s.i. counter-balances the force of the return spring 18 to the extent that the door can be opened upon the application of only approximately one pound of force near its outer edge, normal unassisted opening force being on the order of twelve to sixteen pounds. The residual one pound force resists opening of the door by air currents, as would occur if the return spring were perfectly balanced.

Referring now to FIG. 5, a modified form of the invention is illustrated, wherein elements corresponding to those previously described are designated by like primed (') reference numerals.

The apparatus 10' is so configured and arranged as to provide for operation of a door, rather than mere assist, and operates in response to a remote command. In FIG. 5, there is seen a manual switch element 56, which in its normal, unactuated condition, permits air in the conduit 48' to vent to atmosphere.

Absence of control pressure in the conduit 46' causes the NOT element 34' to pass pressure through the conduit 38' to the timer element 40'. With the application of a control signal to the timer element 40', no pressure is passed to the actuator 28'.

Upon actuation of the switch element 56, however, to interrupt bleeding of pressure in the conduit 48' to atmosphere, a signal is applied to the NOT element 34', and control pressure to the timer element 40' (through the conduit 38') is interrupted. The timer element 40' then passes pressure to the actuator 28'.

As long as the switch element 56 is actuated, flow to the actuator 28' continues, but upon release of the switch element 56, the control signal to the NOT element 34' is lost, and the NOT element 34' again passes pressure to the conduit 38' and the timer element 40'. The timer element 40', after a pre-determined adjustable interval, presently preferred to be on the order of about 20 seconds, then times out, and causes the actuator 28' to be exhausted, thus allowing the door to close in response to the influence of the return spring 18' of the apparatus 10'.

The pressure applied to the actuator 28' in the "operating" mode, it will be understood, must be higher than that used in the "assist" mode, this being so because the force to be applied by the actuator must, in the operating mode overbalance the force of the return spring 18'. The force applied by the actuator 28, 28' is, of course, a function of the size of the actuator piston and the operating pressure. In one present operative embodiment using a three-inch diameter piston, pressures in the range of about 40 to 70 p.s.i. may be used in the operating mode. Speed of operation in the operating mode is a function of air flow, with higher volumes providing, in general, faster and more abrupt operation.

Referring now to FIG. 6, an alternative form of the apparatus in the "operating" mode is illustrated, this form of the apparatus having energy-saving advantage over the embodiment shown in FIG. 5 of not venting air in its steady state. Referring to FIG. 6, a switch element 58 similar to the above-described switch element 56, normally receives air through conduits 36'' and 46'', and passes it through the conduit 38'' to a timer elment 40''. No NOT element is used or needed as in the former embodiment.

Upon actuation of the switch element 58, pressure in the conduit 46'' is vented to the atmosphere, and loss of the signal through the conduit 38'' to the timer element 40'' causes the timer element 40'' to pass air to the conduit 52'' and actuator 28''. Release of the switch element 58 causes the timer element 40'' to time out after the preselected interval.

The switch elements 56 and 58 are, in the illustrated embodiments of the invention so-called "palm buttons" positioned on or near walls or door frames adjacent to the door to be operated by the apparatus 10' or 10'' as the case may be. Thus, a wheelchair-bound patient, for example, approaching the door need only operate the switch element 56 or 58, to effect opening of the door. Other well-known elements, such as mats, treadles, push bars, pneumatic sensors or electric eye sensors might also be used.

The NOT element 34, 34' and timer element 40, 40', 40'' may be any suitable commercially available parts. In present operative embodiments, the products sold by Miller Fluid Power, of Bensenville, Ill., under its Parts. Nos. 50 4065 and 50 6620 have been found satisfactory.

It is an advantage of all three embodiments of the above-described invention that the doors are normally closed, as is desirable or necessary in some applications. Thus, the present invention, in each of its forms, is distinguishable from known prior art devices in which a door is held open, but released either manually or in response to some condition, such as a fire or smoke alarm, and also from devices which simply operate to hold a door open subject to the operation of the closer.

Referring now to FIG. 7, an alternative and presently preferred form of the apparatus is illustrated.

The reference numeral 60 in FIG. 7 designates a fluid relay, that is, an element which operates as a valve and permits the passage of operating pressure in response to the application to it of a control signal, also manifested by fluid pressure. One suitable commercially available fluid relay is sold by Numatics, Incorporated, of Highland, Mich., as the "Numatrol II", Model R.A. 7-0101 relay valve. The relay 60 is coupled to a source of filtered and regulated air through a supply conduit 62 and additional conduits 64 and 66. The conduit 64, as will now be explained, provides control pressure to the relay 60 and the conduit 66 provides operating pressure.

Disposed in the conduit 62 is a limit valve 68, the function of which will shortly be described in greater detail. Disposed in the conduit 64 are an adjustable flow control and reducing valve 70 and an accumulator 72. The flow control and reducing valve 70 and accumulator 72 reduce and moderate the pressure in the conduit 64 to a control pressure less than the pressure in the conduits 62 and 66, suitable for operation of the relay 60.

The limit valve 68 is of the normally open type, so as to normally pass fluid through it, but when the door is closed the limit valve 68 is also maintained in closed condition. When the door is moved ajar by approximately one-half inch to one inch, the limit valve 68 is permitted to assume its normal open condition and the conduits 64 and 66 are pressurized. Pressurization of the conduit 66 causes the relay to pass operating pressure from the conduit 66 to a conduit 74, through a flow control and reducing valve 76, a regulator 78, and ultimately to a cylinder 80 corresponding to the above-described cylinders 28, 28' and 28''. Pressurization of the cylinder 80 occurs soon after pressurization of the conduit 66, and causes the door to open fully.

The application of control pressure sufficient to operate the relay 60 is delayed, however, in accordance with a time constant provided by the accumulator 72, so that the relay 60 remains in the configuration depicted in FIG. 7 for a period of time sufficient for the door to reach full opening. Operation of the relay 60 by pressure in the conduit 64 vents the conduit 74 to the atmosphere, and thus permits the pressure in the cylinder 80 to bleed to the atmosphere. De-pressurization of the cylinder 80 permits the closer apparatus to operate in a conventional manner to close the door.

Referring now to FIG. 8, there is seen, in schematic, a pneumatic system by which an actuator may be controlled to assist opening of a door. Such apparatus provides for economy of operation by using what is essentially an inert system until door movement occurs.

Referring to FIG. 8, wherein elements corresponding to those previously described are sometimes referred to by like primed referenced numerals, a supply conduit 62' provides, through branch conduits 82 and 84, a supply of filtered and regulated air. The conduit 82 is selectively coupled, through a relay 60' to a conduit 74' with which a regulator 78' is associated. The conduit 74' ultimately feeds a cylinder 80' associated with a door closer in the manner of the above-described cylinders 28, 28' and 28''. The conduit 84 communicates with a limit valve 68', and is operatively coupled to a conduit 64' which has associated with it a flow control and reducing valve 70' and accumulator 72'.

The limit valve 68' is of the normally closed type, but when the door is closed is maintained in an open condition, against its bias, so as to permit it to pass fluid through the conduits 84 and 64', to the relay 60'. Operation of the relay 60' permits communication through the conduits 82 and 74' of operating pressure to the cylinder 80'. The above-described apparatus provides an "assist" function, so that the bias-opposing force provided by the cylinder 80' counterbalances the operation of the closure sufficiently that the door may be opened upon the application of 3 to 5 pounds of force. Opening of the door, it will be appreciated, permits the limit valve 68' to return to its normally closed condition, enabling the conduit 64' to vent and the relay 60' to assume its closed condition, to cut off pressure in the conduit 74'. Upon the loss of pressure in the conduit 74', the relay 60' permits pressure within the cylinder 80' to bleed to atmosphere, thus permitting the closer to operate in a conventional manner to apply conventional closing forces to the door.

Figure 9:
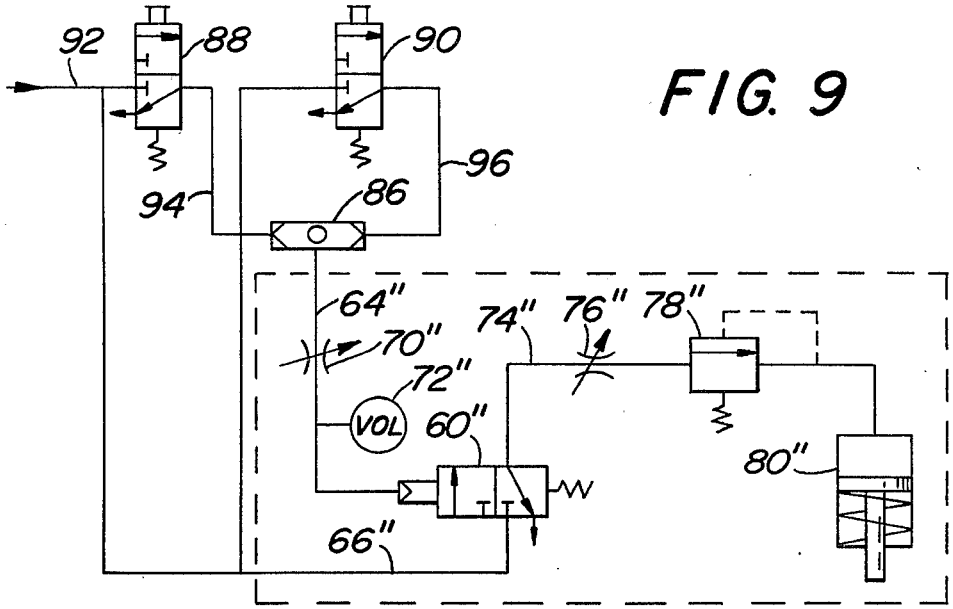
FIG. 9 is a schematic diagram showing an alternative form of control system for the apparatus, in which an operating force is applied to the door in response to actuation of a selected switch.

Referring now to FIG. 9, there is seen an embodiment of the apparatus in which momentary operation of either of two switches causes door to open, delay, and then close.

With reference to FIG. 9, wherein elements corresponding to those previously described are sometimes referred to by like, primed referenced numerals, a system consisting of a fluid relay 60'' receives operating pressure through a conduit 66'' and is capable of passing that pressure through a conduit 74'', a flow control and reducing valve 76'' and regulator 78'', to a cylinder 80''. The relay 60'' receives control pressure through a conduit 64'', a flow control and reducing valve 70'' and accumulator 72''.

The relay 60'' in the embodiment shown in FIG. 9 is controlled by a shuttle valve 86, the position of which is responsive to operation of one or the other of a pair of switches 88 and 90. Actuation of either of the switches 88 and 90 places a source conduit 92 in fluid communication, by means of a conduit 94 or a conduit 96, with the shuttle valve 86, the output of the shuttle valve being in fluid communication with the conduit 64''.

Pressurization of the conduit 64'' serves to actuate the relay 60'', and to pressurize the conduit 74'' and cylinder 80'' to over-balance the bias of the closer and open the door. The door then remains open until, as before, the relay 60' causes the pressure in the cylinder 80'' to bleed off.

The switches 88 and 90 may be positioned at any suitable and convenient location, such as, for example, on opposite approaches to a door; in high and low positions to accommodate ambulatory and wheelchair bound persons. They could also, consistent with the above principles, be incorporated into treadles or other such devices.

Figure 10:
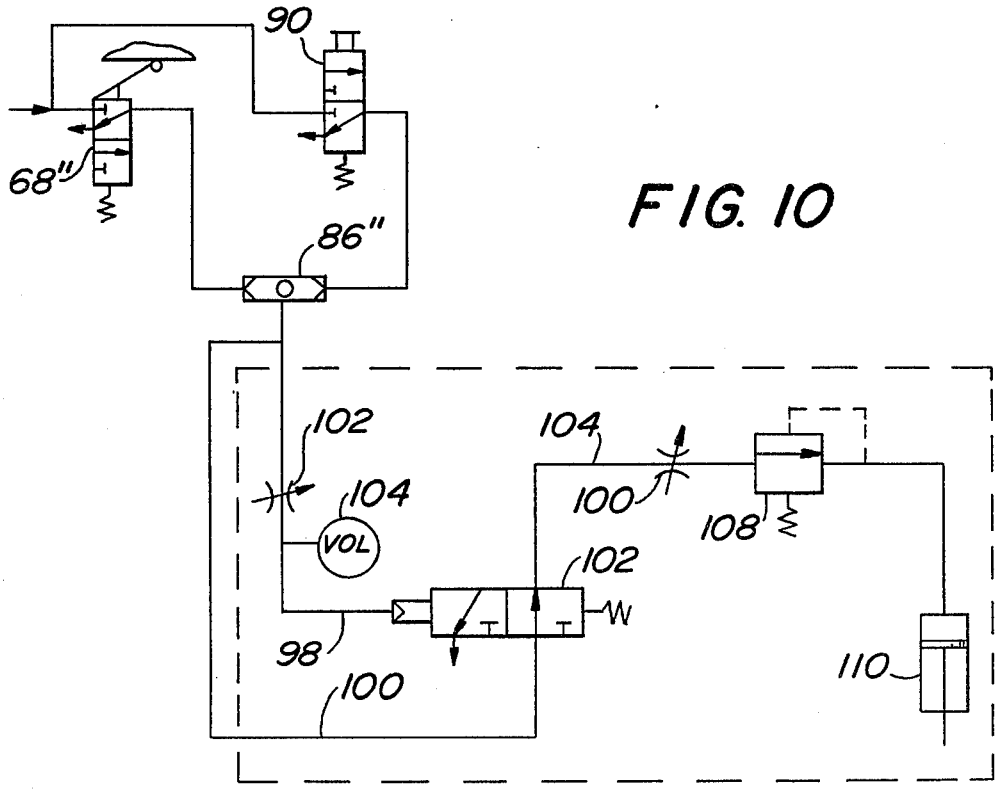
FIG. 10 is a schematic diagram showing an alternative form of control system for the apparatus, in which an operating force is applied to the door in response to actuation of a switch or initial displacement of the door.

In FIG. 10, there is seen an embodiment of the apparatus generally similar to that of FIGS. 8 and 9, but in which operation of a door is initiated by either a door-position responsive switch or a switch of the push-button type. Referring to FIG. 10, a limit valve 68'' and switch 90' are coupled to a shuttle valve 86'', the output of the shuttle valve 86'' serving to charge conduits 98 and 100. Associated with the conduit 98 is a flow control and reducing valve 102 and an accumulator 104.

Actuation of either the limit valve 68'' or switch 90', it will be seen, causes operating pressure to pass through the conduit 100, the relay valve 102, a conduit 104, flow control valve 106, a regulator 108 and into the operating cylinder 110. Operation of the limit valve 68'' occurs upon initial opening of the door. Operation of the switch 90' causes opening of the door, and, in sequence, operation of the limit valve 68''.

Charging of the conduit 102 eventually causes shifting of the relay valve 102 to permit pressure in the cylinder 110 to bleed through the relay valve 102 to atmopshere, thus enabling the door to close under the influence of the door closer.

The present invention may be embodied in other specific forms without departing from its spirit and essential attributes and, accordingly, reference should be made to the appended claims rather than the foregoing specifications as indicating the scope of the invention.

I claim:

1. Hydraulic door closer apparatus comprising a housing having a cylinder therein, a piston disposed in said cylinder, force transmitting means operatively coupled to said piston for transmitting forces to and from said piston to control movement of a door, biasing means in said cylinder in force-transmitting engagement with said piston for biasing said piston toward a rest position, actuator means operatively coupled to said piston for selectively applying to said piston force in opposition to said biasing means, said actuator means being secured to said housing and including a force-transmitting member in force-transmitting engagement with said piston and operable in a direction parallel to the axis of said cylinder and said piston to oppose said biasing means, said actuator means being a fluid actuator of the pneumatic type, and control means operatively coupled to said actuator means for selectively operating said actuator means, said control means comprising a source of air pressure, conduit means coupled to said source and said actuator means, a fluid relay disposed in said conduit means, and manually operable means operatively associated with said conduit means for selectively operating said fluid relay and placing said actuator means in fluid communication with said source, said manually operable means comprising time-responsive means for interrupting fluid communication between said source and said actuator when said time-responsive means times out, and valve means operatively coupled to said fluid relay, said time-responsive means and said source, so that actuation of said valve means causes said time-responsive means to operate, said time-responsive valve being so constructed and arranged that said actuator means is rendered inoperative when said time-responsive means is timed out.

2. Apparatus in accordance with claim 1 wherein said valve means comprises switch means responsive to door position, whereby said valve means operates in response to door position.

3. Apparatus in accordance with claim 2, wherein said actuator means is so configured and arranged as to provide a force approximately equal to the force of said biasing means so that the effect of said biasing means is nearly balanced and movement of a door facilitated thereby, said valve means being of the normally closed type and maintained in an open position when the door is closed, closing of valve means causing said time-responsive means to time out.

4. Apparatus in accordance with claim 2, wherein said actuator means is so configured and arranged as to provide a force in excess of the force of said biasing means so that the effect of said biasing means may be overbalanced and the door open thereby, said valve means being of the normally open type and maintained in a closed position when the door is closed so that opening of the door causes actuation of said valve means to an opened position, opening of said valve means causing said actuator to be placed in fluid communication with said source.

5. Apparatus in accordance with claim 4, wherein said fluid relay is so configured and arranged as to place said actuator means in fluid communication with said source upon closing of said valve means, said time-responsive means being operatively coupled to said fluid relay to interrupt fluid communication between said actuator means and said source when said time-responsive means is timed out.

6. Apparatus in accordance with claim 5, wherein said time-responsive means comprises a flow control valve and an accumulator.

7. Apparatus in accordance with claim 1, wherein said actuator means is so configured and arranged as to provide a force in excess of the force of said biasing means so that the effect of said biasing means may be overbalanced, said valve means comprising a plurality of normally closed manually operable valve means, mementary actuation of said valve means causing said actuator to be placed in fluid communication with said source to open the door.

8. Apparatus in accordance with claim 7, wherein said valve means comprises a pair of push-button actuated valves and a shuttle valve operatively coupled to said push-button actuated valves, said fluid relay being so configured and arranged as to place said actuator means in fluid communication with said source in response to a signal transmitted from said shuttle valve.

9. Appartus in accordance with claim 1 wherein said actuator means is so configured and arranged as to provide a force in excess of the force of said biasing means so that the effect of said biasing means may be overbalanced, said valve means comprising a plurality of normally closed valves, one of said valves being a pushbutton actuated valve and the other of said valves being responsive to door position, said position-responsive valve being of the normally open type and maintained in a closed position when the door is closed so that momentary actuation of said one of said valve or manual dislacement of the door causes said actuator to be placed in fluid communication with said source to open the door.

10. Apparatus in accordance with claim 9, and a shuttle valve operatively coupled to said normally closed valves, said fluid relay being so configured and arranged as to place said actuator means in fluid communication with said source in response to opening of either of said normally closed valves, and said time-responsive means being operatively coupled to said to said shuttle valve and said fluid relay to interrupt fluid communication between said actuator means and said source when said time-responsive means is timed out.

* * * * *

UNITED STATES PATENT AND TRADEMARK OFFICE

CERTIFICATE OF CORRECTION

PATENT NO. : 4,339,843

DATED : July 20, 1982

INVENTOR(S) : L. Nelson Burnett, Jr.

It is certified that error appears in the above—identified patent and that said Letters Patent is hereby corrected as shown below:

Column 4, line 15, "parllel" should read -- parallel --.

Column 5, line 26, after the word "way", insert the word -- of --.

Column 7, line 22 should not begin a new paragraph, but continue on after line 21.

Column 10, line 20, "mementary" should read -- momentary --.

Column 10, line 30, "Appartus" should read -- Apparatus".

Signed and Sealed this

Thirtieth Day of November 1982

[SEAL]

*Attest:*

GERALD J. MOSSINGHOFF

*Attesting Officer*

*Commissioner of Patents and Trademarks*